United States Patent [19]

Ibuchi

[11] Patent Number: 4,843,427

[45] Date of Patent: Jun. 27, 1989

[54] SELECTIVE CHARGE REMOVAL SYSTEM FOR COPIER

[75] Inventor: Yoshiaki Ibuchi, Nara, Japan

[73] Assignee: Sharp Kabushiki Kaisha, Osaka, Japan

[21] Appl. No.: 140,822

[22] Filed: Jan. 5, 1988

[30] Foreign Application Priority Data

Jan. 5, 1987 [JP] Japan ..... 62-718
Jan. 5, 1987 [JP] Japan ..... 62-719

[51] Int. Cl.[4] ..... G03G 15/00

[52] U.S. Cl. ..... 355/218; 350/357; 355/326

[58] Field of Search ..... 355/3 R, 7, 14 E, 40, 355/71; 350/356, 357

[56] References Cited

U.S. PATENT DOCUMENTS 4,088,394 5/1978 Shimomura ..... 350/356
4,297,006 10/1981 Bissar ..... 350/357
4,611,906 9/1986 Iwaki ..... 355/7 X

FOREIGN PATENT DOCUMENTS 55-84968 6/1980 Japan ..... 355/7

*Primary Examiner*—A. T. Grimley
*Assistant Examiner*—J. Pendegrass
*Attorney, Agent, or Firm*—Flehr, Hohbach, Test, Albritton & Herbert

[57] ABSTRACT

A selective charge removal system for a copier uses a transparent electrochromic display with many segments or dots thereon and a back-lighting unit such that only a specified area which is precisely defined on the photosensitive body of the copier is exposed to the light from the back-lighting unit. These segments or dots are driven to an intermediate color state during a wait period before a copying operation of the copier is started such that the color conditions of the electrochromic display can be changed quickly.

3 Claims, 6 Drawing Sheets

SELECTIVE CHARGE REMOVAL SYSTEM FOR COPIER

BACKGROUND OF THE INVENTION

This invention relates to a selective charge removal system with which an image produced by a copier can be erased selectively by preliminarily removing charge from specified areas on its photosensitive body.

When the original document to be copied by a copier is too thick or somewhat smaller than a standard size and the copier is operated with its document cover in the open position, undesirable black marks may appear along the edges of the produced copy. On the other hand, some modern copiers are provided with capabilities for editing operations such as trimming, masking, centering and two-color copying by combining these modes of operations. To perform such operations, the user specifies an area on the original by means of numeric keys or a stylus pen and a light-emitting device provided to the copier selectively erases the electrostatic latent image formed on the photosensitive body. Such a light-emitting device typically comprises a large number of light-emitting diodes mutually screened apart by screening plates and disposed in a single column along a straight line perpendicular to the direction of transportation of copy sheets. The unsightly black marks along the edges and the like can thus be erased by such a device but a device with many light-emitting diodes arranged in a line is difficult to assemble and inconveniently costly. Moreover, the resolution of such a light-emitting device is determined by the pitch of the constituent diodes which is usually as big as about 2.5–2.7 mm and this means that charge cannot be removed very accurately.

In the case of a composite copying mode of operation in two colors by using the masking method, for example, the problem of resolution may arise as follows. With reference to FIG. 1 which shows the positional relationship between a specified area on an original document to be copied and a light-emitting device as well as the image which is copied, a rectangular area is specified by inputting the positions of its diagonal corner points such as $P_1$ and $P_2$ such that the areas inside and outside this rectangle are copied in different colors M and N, respectively. Along the boundary lines which are perpendicular to the direction of the light-emitting device (indicated by numeral 7), however, the two colors may overlap or there may appear an area with no color at all because of the inadequate resolution as shown by letter L.

SUMMARY OF THE INVENTION

It is therefore an object of the present invention to eliminate the disadvantages of the prior art selective charge removal system for a copier and to provide an inexpensive light-emitting device and a new selective charge removal system with improved resolution.

The above and other objects of the present invention are achieved by providing a selective charge removal system for a copier with a light-emitting device which comprises a transparent electrochromic display with many segments or dots and a back-lighting unit. Charge is removed from the surface of the photosensitive body of the copier because this transparent electrochromic display serves to selectively allow the light from the back-lighting unit to pass therethrough. Since segments and dots can be arranged at a narrower pitch in an electrochromic display than conventional light-emitting diodes, charge can be removed from a specified area with improved resolution.

In another aspect of the present invention, the charge removal system further comprises means for controlling the operation of the display such that each segment or dot of the display is driven to a state of having an intermediate color during a wait period prior to the start of a copying operation. Although electrochromic displays using a conventional electrochromic material generally have a slower response time than display devices of other types, the aforementioned method of the present invention serves to speed up the operation of coloring and erasing because the segments and dots are initially in an intermediate color state.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
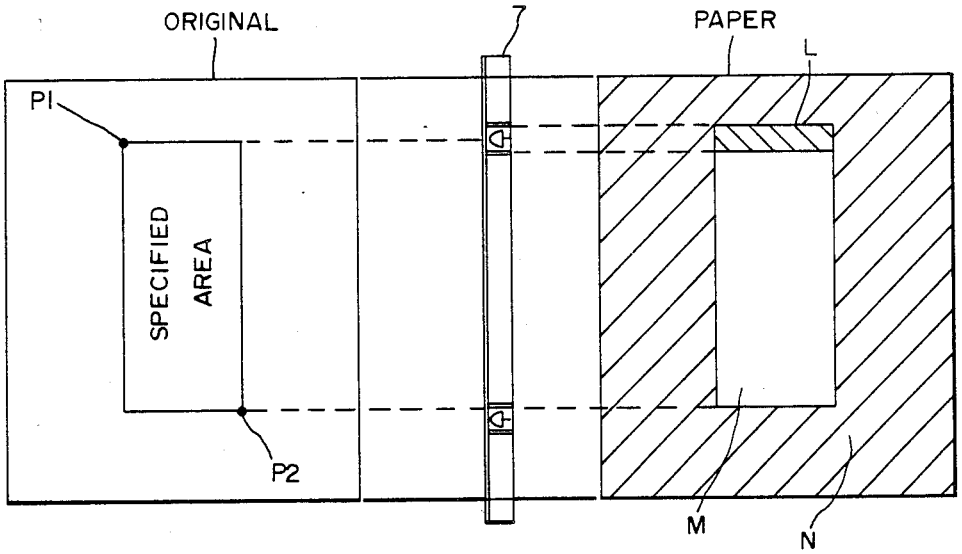
(PRIOR ART) FIG.—1
FIG. 1 is a drawing for explaining problems encountered by a prior art copier.
Figure 2:
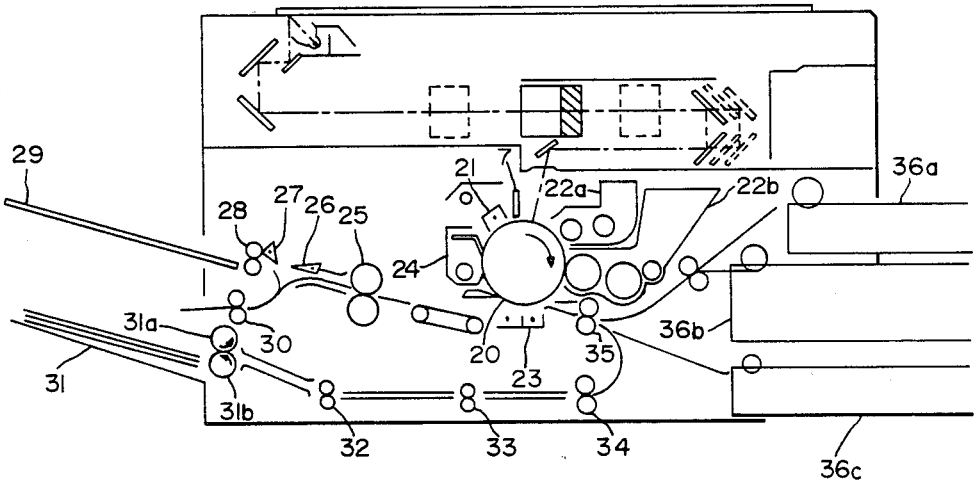
FIG. 2 is a schematic sectional view of a copier incorporating a selective charge removal system embodying the present invention.

With reference to FIG. 2 which shows the structure of a copier incorporating a selective charge removal system embodying the present invention, a photosensitive drum 20 is disposed nearly at the center of the copier housing, surrounded by various units for performing the copying process such as a primary charger 21, a light-emitting device 7, a first developing unit 22*a*, a second developing unit 22*b*, a transfer and paper removal charger 23 and a cleaner unit 24. The light-emitting device 7 is for selectively removing charge from the surface of the photosensitive drum 20 charged by the primary charger 21 and includes, as will be explained more in detail later, a back-lighting unit and an electrochromic display. A copy paper sheet selectively supplied from one of cassettes 36*a*, 36*b* and 36*c* is transported in the direction of the photosensitive drum 20 through synchronization rollers 35. After a toner image is transferred onto the sheet, the image is fixed by fixing rollers 25 and the sheet is transported by the operations of claws 26 and 27 either directly into a discharge tray 31 or temporarily into another tray 29 from which it is transported backwards by reverse rollers 28 into the discharge tray 31 through rollers 30. A choice between these two modes of paper transportation is made, depending on whether copying is effected on both sides of the copy paper or a composite copy is desired on one side. If copying is to be effected for the second time on a sheet which is already in the discharge tray 31, rollers 31*a* and 31*b* are used to selectively transport only the top sheet in the discharge tray 31 in the direction of the synchronization rollers 35 through rollers 32, 33 and 34.

Figure 3:
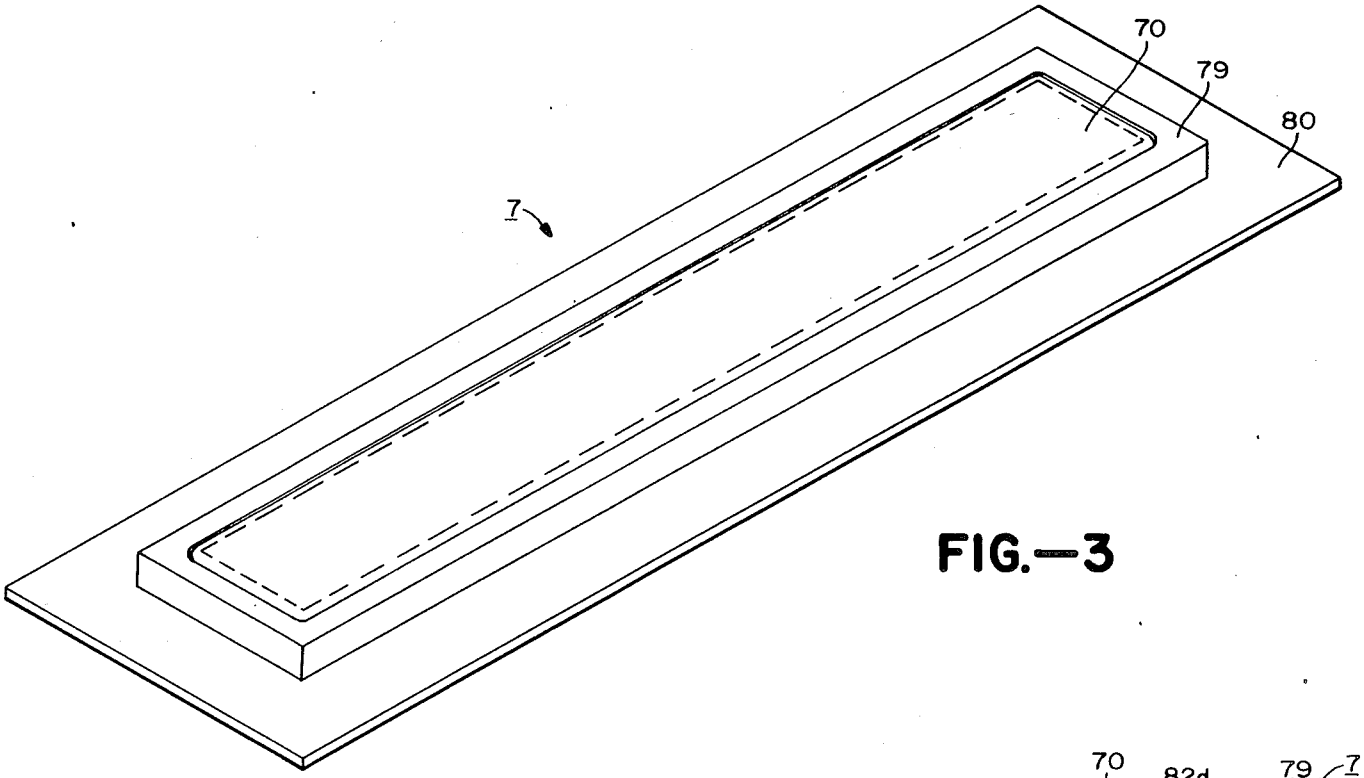
FIG. 3 is a perspective view of a light-emitting device in the copier of FIG. 2, FIGS. 4A and 4B are respectively a front view and a side sectional view of the light-emitting device of FIG. 3.
Figure 4A:
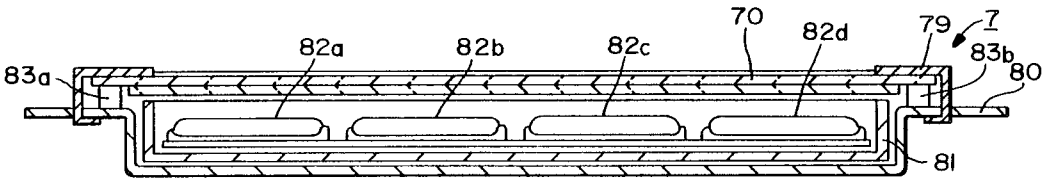
Figure 4B:
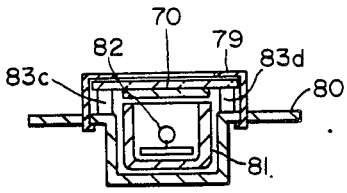

The light-emitting device 7 for removing charge selectively from a specified area on the photosensitive drum 20, as shown in FIGS. 3, 4A and 4B, comprises an electrochromic display 70 which is fastened to a metallic base frame 80 of a circuit board by means of an angle plate 79. An indentation is formed in the base frame 80 and contains the electrochromic display 70 connected electrically through connectors 83*a*, 83*b*, 83*c* and 83*d*. The space formed between the display 70 and the indentation in the base frame 80 contains a back-lighting unit comprised of four lamps 82*a*, 82*b*, 82*c* and 82*d* and a reflective case 81. With a light-emitting device thus formed, light from the back-lighting unit can be selectively introduced to the surface of the photosensitive drum 20 by switching on and off each segment of the electrochromic display 70.

Figure 5:
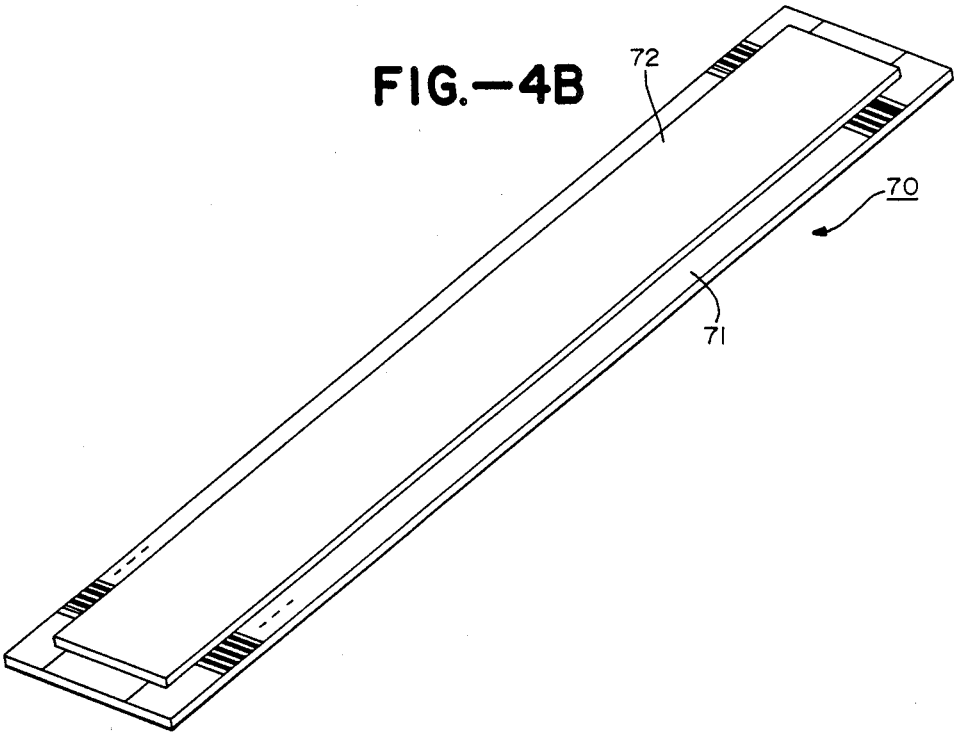
FIG. 5 is a perspective view of an electrochromic display in the light-emitting device of FIG. 3.
Figure 6:
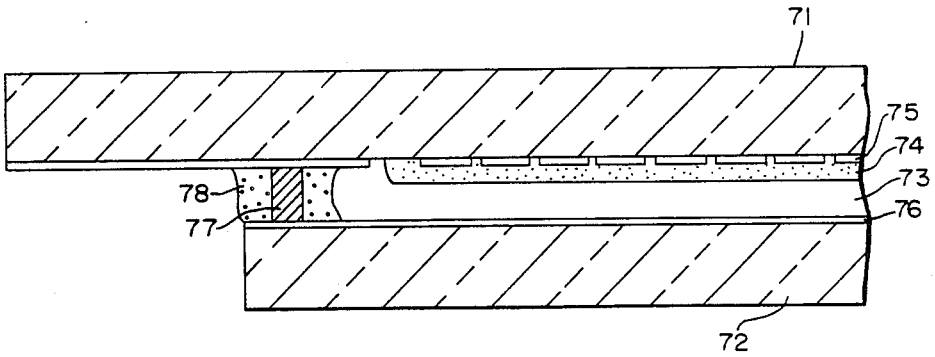
FIG. 6 is a sectional view of a part of the electrochromic display of FIG. 5.
Figure 7:
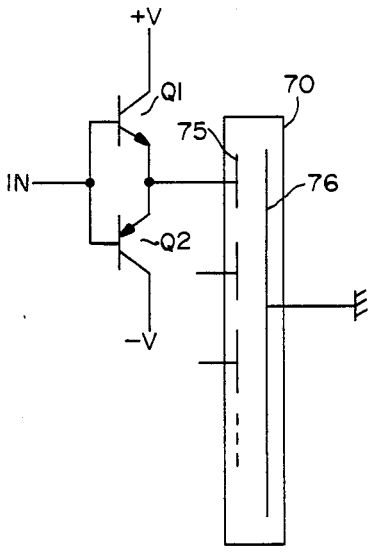
FIG. 7 is a circuit diagram of the final stage of a driver circuit for operating the electrochromic display of FIGS. 5 and 6.
Figure 8:
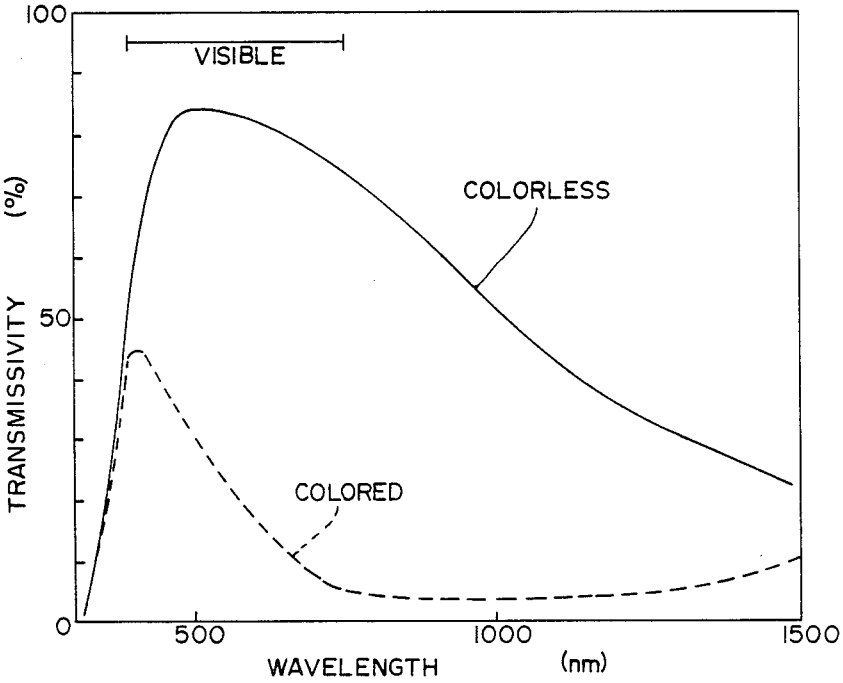
FIG. 8 is a graph showing the relationship between transmissivity and wavelength of the electrochromic display of FIGS. 5 and 6 in its on and off states.

The electrochromic display 70 is formed between two glass plates 71 and 72 as shown in FIGS. 5 and 6. One of the glass plates (71) is provided on its surface with a plurality of segments 75 made of a transparent electroconductive film, and this surface is covered with an electrochromic material 74. The other glass plate 72 has an electrode 76 of a transparent electroconductive film formed over its entire surface and an electrolyte 73 is contained between these two glass plates 71 and 72. A sealing material 78 is used along the periphery of the area over which these plates 71 and 72 are placed opposite each other to seal the electrolyte 73 inside. Conductive pieces 77 for making contacts with the transparent electrode 76 are provided at specified positions inside this sealing material 78. A blue display can be made if tungston oxide is used as the electrochromic material 74 and a negative charge is transmitted to the segment from the opposite electrode and the color can be made to disappear if a current is passed in the opposite direction. If iridium hydroxide is used as the electrochromic material, a display in gray can be made and erased similarly. Such a choice is made generally according to the sensitivity characteristics of the photosensitive drum. With reference next to FIG. 7 which shows the final stage of a circuit for driving the electrochromic display explained above, the transistor $Q_2$ is switched on if a negative voltage $-V$ is applied to the input terminal IN and the segment 75 becomes colored. The transistor $Q_1$ is switched on if a positive voltage $+V$ is applied and the segment 75 becomes colorless. FIG. 8 shows that the electrochromic display 70 has a particularly high contrast in transmissivity between the on (colored) and off (colorless) states in the visible range wherein the photosensitive drum is sensitive. In other words, the electrochromic display 70 is capable of selectively removing charge with sufficient accuracy.

Figure 9:
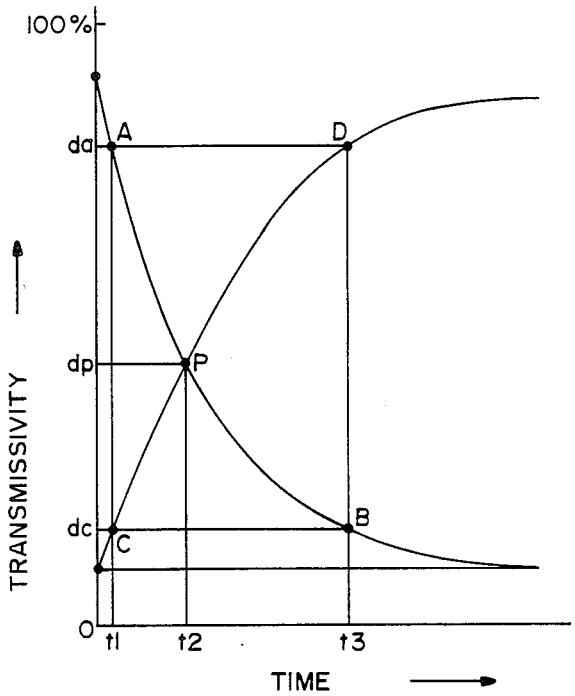
FIG. 9 is a graph showing the time-rate of change in transmissivity of the electrochromic display of FIGS. 5 and 6.

With reference next to FIG. 9 which shows the time-rate of change in transmissivity of the electrochromic display 70, the curve A-P-B represents the change in transmissivity if a coloring current is passed through it when it is initially (at $t_1$) in the off condition with its transmissivity da and the curve C-P-D represents the change if an erase current is passed through it when it is initially (at $t_1$) in the colored condition with its transmissivity dc. The point P represents a condition in which the electrochromic display 70 has an intermediate color of transparency dp. The time required to color the display 70 from this intermediate color condition is $t_3-t_2$ and the time required to erase the color from this intermediate color condition is also $t_3-t_2$. In other words, a desired (colored or colorless) display can be obtained relatively quickly (compared to $t_3-t_1$) if the display 70 is operated from this intermediate color condition.

Figure 10:
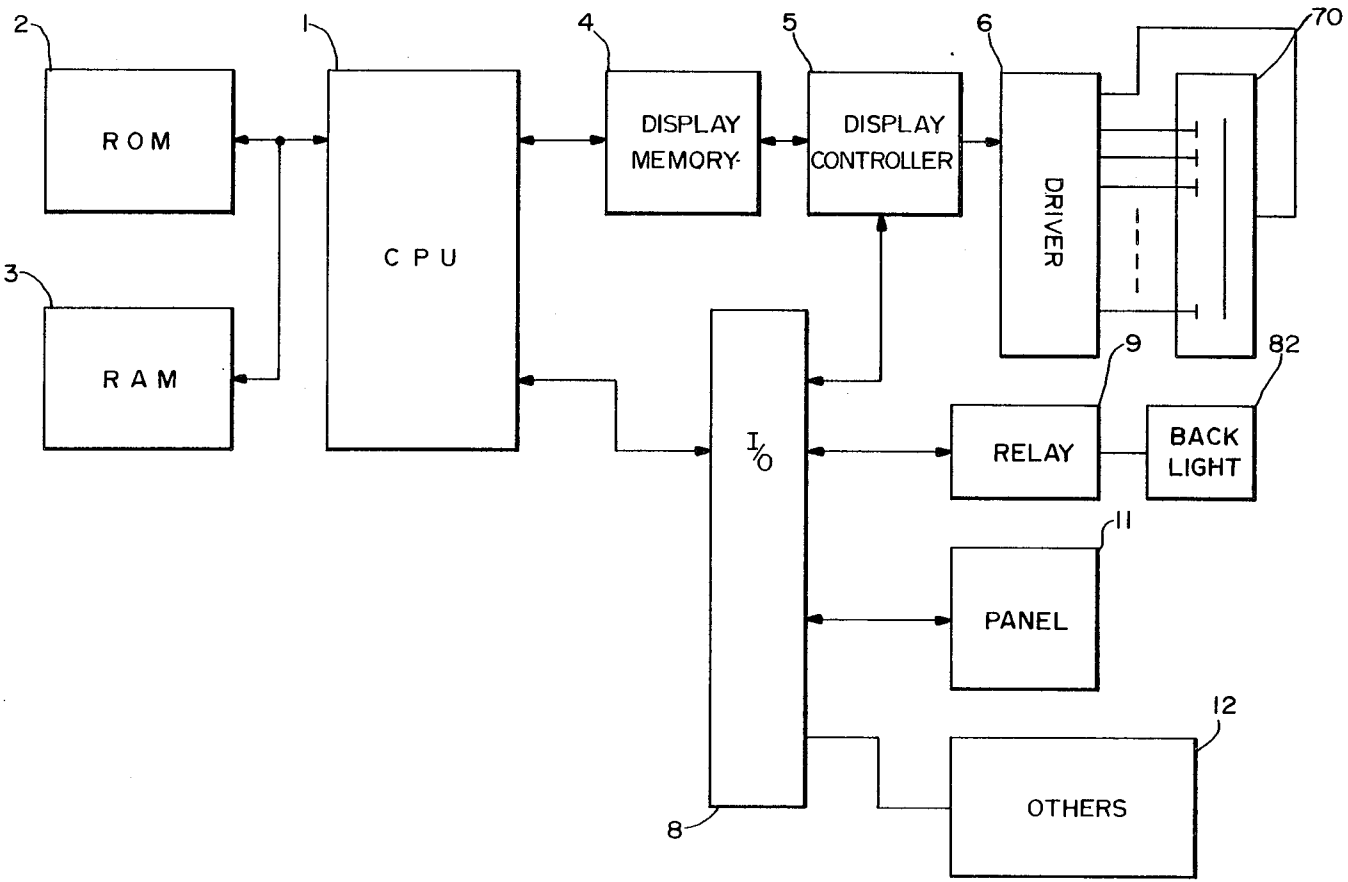
FIG. 10 is a block diagram of the control unit of the copier of FIG. 2.

FIG. 10 is a block diagram of the control unit of the copier shown in FIG. 2 and described above as incorporating a light-emitting device of the present invention. The overall control is carried out by a central processing unit CPU 1 according to a program preliminarily stored in a read-only memory ROM 2. A random-access memory RAM 3 is used as various working areas in the execution of this program. Numeral 4 indicates a display memory for storing the contents of display by the electrochromic display 70. Such a stored content of display is adapted to be retrieved by a display controller 5 which outputs a corresponding display control signal to a driver 6. The driver 6 contains a driver circuit shown in FIG. 7 at its output end and serves to selectively color or erase the segments of the electrochromic display 70. Numeral 9 indicates a relay for performing the on/off control of the back lamps 82. The CPU 1 activates the relay 9 through an I/O port 8 according to an appropriate timing schedule. Numeral 11 indicates a control panel having as an input means through which the user can specify an area on an image in an editing mode of operation such as trimming and masking. The inputted information is received by the CPU 1 which, in turn, records it in the display memory 4. Also connected to the I/O port 8 are a copy lamp, a heater lamp for the fixing rollers 25, motors for driving the rollers, all kinds of sensors for detecting, for example, whether a copy paper sheet has been supplied, etc. With a control unit thus structured, the CPU 1 monitors the elapsed time from the starting of an operation and after a specified time interval, an on/off pattern for the electrochromic display 70 is written in the display memory 4. At the same time, a display control signal is transmitted to the display controller 5 for a desired display. The relay 9 is also activated according to a specified timing schedule to control the back lamps 82.

Figure 11:
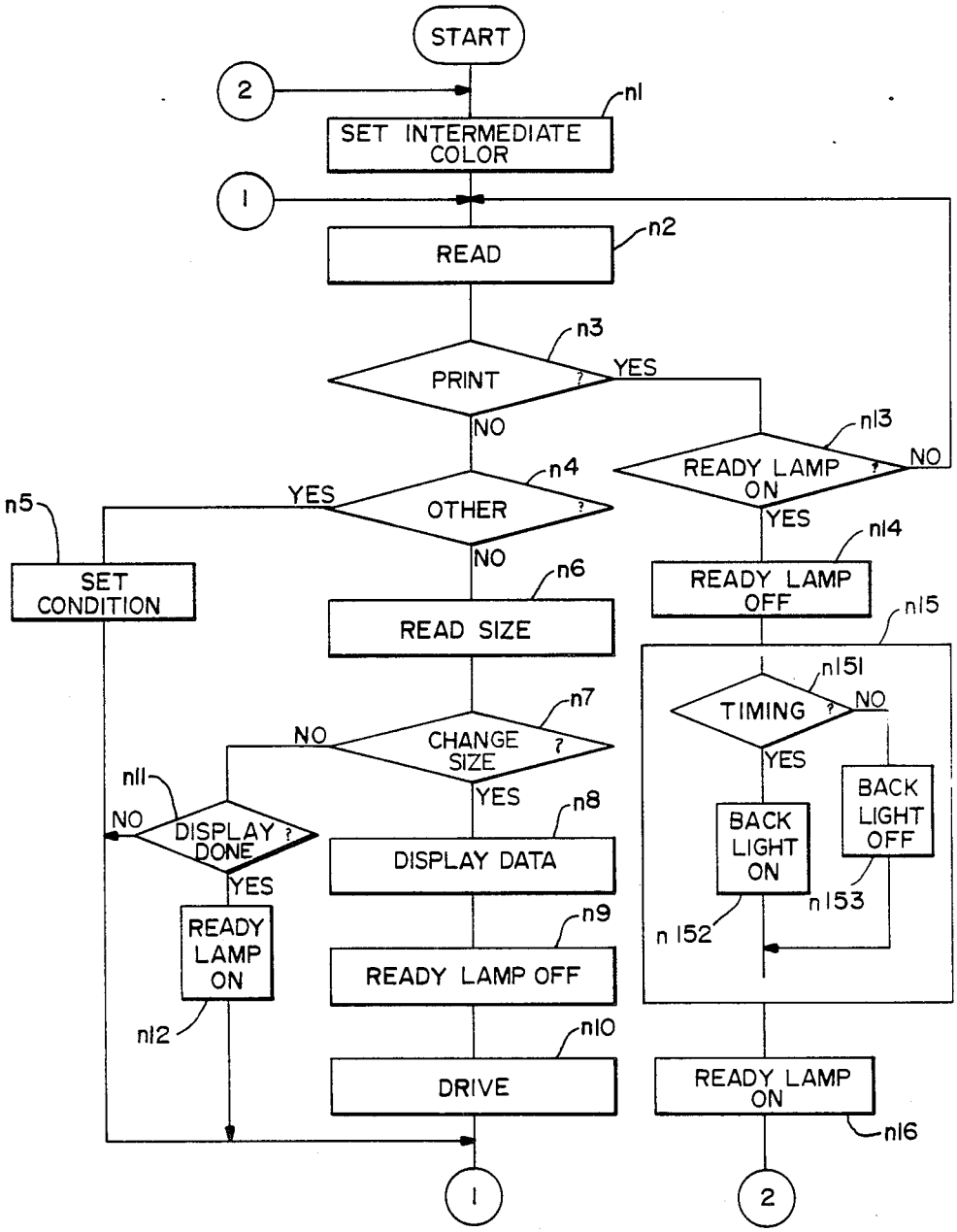
FIG. 11 is a flow chart of the operation of the central processing unit of FIG. 10.

The operation of the CPU 1 outlined above is explained next by way of the flow chart shown in FIG. 11. According to a mode of operation embodying the present invention, the CPU 1 starts by transmitting to the display controller 5 a command to drive the electrochromic display 70 into the intermediate color defined above in connection with FIG. 9 (n1). When this command is received, the display controller 5 causes an erase current to flow for a time duration given by $t_3-t_2$ of FIG. 9 to those segments which are already in the colored state and a coloring current likewise to those segments which are in the off state. As a result, all segments are driven to the intermediate color condition. Thereafter, the CPU 1 interprets the operated keys (n2). If the user operates a key or keys to set the copying conditions (n5 after NO in n3), such conditions are set. If the user does not operate any key (NO in n3 and n4), the size of the original document to be copied is detected (n6) and display data representing the area from which charge should be removed according to the detected document size are recorded in memory 4 (n8). A ready lamp for indicating that the copier is ready for a copying operation is thereafter switched off (n9) and a command signal is transmitted to the display controller 5 to drive the electrochromic display 70 according to the contents of the display memory 4 (n10).

If the driver 6 completes the operation of the electrochromic display 70 (YES in n11), the CPU 1 switches off the ready lamp (n12). If it is detected that the document being copied has moved or otherwise that the document area has changed (YES in n7), display data are reentered (n8) as explained above.

If the print key (not shown) of the copier is operated after the on and off states of the electrochromic display 70 are determined (YES in n3), the ready lamp is turned off (n14) and the regular copying operation is carried out (n15). During such a copying operation, the back lamps are turned on (n152) whenever the time to do so is detected (n151) and they are kept turned off at other times (n153). After the copying operation is completed, the ready lamp is turned on again (n16) and all segments of the electrochromic display 70 are driven to the intermediate color (n1). The advantage of setting all segments in the intermediate color before each copying operation is started is that the display condition can be changed quickly as soon as the document area is determined.

In summary, the present invention discloses a light-emitting device comprised of a transparent electrochromic display with many segments or dots and a back-lighting unit for selectively removing charge from the surface of the photosensitive body. As a result, charge can be removed with an extremely small pitch and hence with an extremely high resolution. Thus, composite copying can be effected without overlapping or missing areas at the boundaries. Since it is no longer necessary to assemble a large number of light-emitting elements, the cost can be reduced. With the driving method of the present invention, furthermore, a display can be made quickly even with a display device with a relatively slow response time.

The foregoing description of preferred embodiments of the invention has been presented for purposes of illustration and description. It is not intended to be exhaustive or to limit the invention to the precise form disclosed, and many modifications and variations are possible in light of the above teaching. For example, the segments 75 shown in FIG. 6 may be replaced by dot electrodes as mentioned above. Any modifications and variations that may be apparent to a person skilled in the art are intended to be included within the scope of this invention.

What is claimed is:

1. In a selective charge removal system for a copier, said copier comprising a photosensitive body, charging means for charging said photosensitive body, developing means for developing an image on said photosensitive body, light-emitting means disposed between said charging means and said developing means for selectively removing charge either from an electrostatic latent image formed on said photosensitive body or from a specified area on said photosensitive body for forming an electrostatic latent image thereon, and control means for controlling the operation of said light-emitting means, the improvement wherein said light-emitting means comprise a transparent electrochromic display having a plurality of segments or dots arranged thereon, and a back-lighting unit, said control means including driving means for driving each of said segments or dots into an intermediate color condition during a wait period prior to a copying operation of said copier, said intermediate color condition being a state between the colored and colorless states of said segments or dots, whereby the display conditions of said electrochromic display can be changed more quickly.

2. The system of claim 1 wherein said electrochromic display is disposed between said back-lighting unit and said photosensitive body.

3. The system of claim 1 wherein said electrochromic display comprises a first transparent plate and a second transparent plate disposed in a mutually parallel relationship with respect to each other, said segments or said dots being disposed on said first transparent plate, a transparent electrode being disposed on said second transparent plate said first transparent plate being covered with an electrochromic material, and said first and second transparent plates sandwiching an electrolyte therebetween.

* * * * *